US006089989A

United States Patent [19]

Sutcliffe

[11] Patent Number: 6,089,989

[45] Date of Patent: Jul. 18, 2000

[54] GOLF SWING TRAINING DEVICE AND METHOD

[76] Inventor: James L. Sutcliffe, P.O. Box 5684, Lake Montezuma, Ariz. 86342

[21] Appl. No.: 09/246,898

[22] Filed: Feb. 8, 1999

[51] Int. Cl.[7] ..... A63B 69/36

[52] U.S. Cl. ..... 473/225; 473/262; 473/265

[58] Field of Search ..... 473/197, 261, 473/263, 265, 264, 225, 257, 262

[56] References Cited

U.S. PATENT DOCUMENTS

| | | | |
|---|---|---|---|
| 1,383,876 | 7/1921 | Sullivan | 473/265 |
| 4,732,390 | 3/1988 | McCollum | 473/264 |
| 5,116,056 | 5/1992 | Schmutte | 473/172 |
| 5,224,709 | 7/1993 | Burk | 473/263 |
| 5,467,990 | 11/1995 | Kitzhaber | 473/197 X |
| 5,482,269 | 1/1996 | Scott et al. | 473/197 X |

*Primary Examiner*—Jeanette Chapman
*Assistant Examiner*—Stephen L. Blau
*Attorney, Agent, or Firm*—Gregory J. Nelson

[57] ABSTRACT

A golf instructional apparatus designed to teach a golfer to hit the ball straight and to correct a golfer's hook or slice. The apparatus is also capable of teaching a golfer how to hit a hook or slice. A golf mat is located in a designated ball hitting area having a reference line. A flexible cylinder is located forwardly and outside the ball striking area, which the golfer may hit on the through swing if the club is incorrectly swung. A flexible panel is suspended facing the golfer and will be struck by an incorrect over-the-top swing. The flexible panel allows the golfer to practice at full speed as there are no obstructions in the ball hitting area. The apparatus can be used with or without a ball as immediate feedback is provided. The panel has an indicator mark placed on it forward of the golfer which the golfer attempts to hit when learning draws, hooks or to help change the golfer's slice pattern. A sensor is positioned forward and rearward the hitting area. If the golfer takes the club back correctly, a signal will be given and if incorrectly taken back, no signal. The same is true with the follow through swing.

11 Claims, 4 Drawing Sheets

GOLF SWING TRAINING DEVICE AND METHOD

FIELD OF THE INVENTION

The present invention relates to a golf training device and more particularly relates to a device for training a golfer in the proper swing path.

BACKGROUND OF THE INVENTION

The golf swing appears simple but is one of the more difficult motions to learn and to maintain once learned. This is because the golf swing involves the use of a number of movements and muscles which must be coordinated. The torso of the golfer is turning or rotating. Simultaneously, a weight shift occurs from the left side to the right side for right-handed golfers. The club is moved and the arms swing to the right until the golf club is in a set position at the top of the back swing. The golfer then begins a weight shift transferring the weight back to the left side which will result in the golfer turning leftwardly causing the club to move from its position at the top of the backswing through the ball. With the proper finish, the golfer should have shifted the weight to the left foot and should be looking down the path of the shot after the ball is struck. The proper swing plane may vary in accordance with the individual golfer. However, basically, the club head should follow a swing path with respect to the intended line of ball travel which moves rearwardly from the ball along a line corresponding to the intended line of ball travel and then due to the turn of the body slightly inwardly and upwardly. The swing path is reversed when the ball is struck and the downswing preferably is an inside to out swing path in which the club follows the rotation of the golfer's body and drops downwardly and the club head is squared as it approaches the ball.

Accordingly, a golfer should learn to take the club head at least initially rearwardly in a straight line along the intended path of the ball flight. Similarly, after striking or impacting the ball, the club head should also follow a straight path for a distance. Many of the difficulties with which golfers encounter is a result of either not taking the club head along a straight line during the back swing or not continuing on a straight line through the ball for at least a short distance.

The prior art includes many training aides and devices to assist in teaching golfers a proper swing plane and swing path. One device which is widely promoted and is quite popular consists of a large diameter ring which is supported at an angle corresponding to a desired swing plane. The golfer stands within the ring and swings the golf club so that it remains in contact with the ring during the back swing and as well as during the follow through. The disadvantage of this device is that it is rather awkward and unwieldy and does not easily lend itself to home use. Further, the device must be adjusted for each individual because the swing plane of individual golfers varies considerably depending upon the physical characteristics of the golfer and of the golfer's swing. Also, it is easy for the golfer to "come over the top" with this device since forward motion of the club is not restricted.

An early golf practice device is shown in U.S. Pat. No. 1,383,876 which shows a golf practicing device having a base approximately three feet long. The base supports a plurality of plates or shutters which are suspended from the base. If the club is correctly swung, the club head will follow a path and will not strike the suspended shutters or panels. If, however, the golf club is not correctly swung, it will strike one of the panels either behind the ball indicating a slice or the panel ahead of the ball indicating a pull. Striking the intermediate panel may indicate a heeled or topped ball. While the device of the '876 patent may be of some assistance in teaching the proper swing, the device is a relatively low profile device and it is possible for a golfer to improperly swing the club coming over the top or swinging in a manner which would pull the ball and not strike the device because of its low profile. In other words, the golfer could still exhibit an improper swing and miss the practice device of the '876 patent entirely.

U.S. Pat. No. 3,125,343 discloses a barricade of resilient material which is intended to correct the improper golf swing which produces a slice. The barricade is supported on a base which base carries markings to assist in positioning the device relative to the golf ball. The barricade is positioned adjacent the desired path of travel of the golf ball so the club will not strike the barricade when swung properly but if the club travels a path which produces a fault in the swing, the club will strike the barricade. If the golfer executes a proper swing, the club does not contact the barricade and the golfer's efforts are rewarded by striking the ball in the proper manner. While this device is similar in principle to that shown in the '876 patent, it has the same disadvantages in that the golfer can still execute an improper swing and yet miss the barricade and not receive the feedback that the golf club has been swung improperly.

U.S. Pat. No. 3,586,335 shows a rectangular base having a grass surface and a flat portion on which the golfer stands. A plastic tee is located on the grass portion and a pair of truncated hedge members are positioned adjacent the line extending through the plastic tee and in line with the proper golfer swing forming a straight swing area defined by the hedges. The golfer learns by attempting to swing straight through the opening without contacting either of the pair of hedges which it is claimed will eliminate hooking and slicing. Again, the hedges are low profile members positioned close to the mat and further are positioned only forward of the ball so that the golfer may execute an improper take-away or an improper swing and still maintain the club head without striking the hedges.

U.S. Pat. No. 4,913,440 shows a golf club swing training apparatus having a mat of artificial width and artificial grass surface. The grass surface is provided with a plurality of openings at locations on the mat for selective disposition of upstanding swing guide members to permit the user to arrange the guide members to define any desired golf swing path, as for example, inside the square for a straight path. This device is similar to the other devices described above and will assist golfers in training themselves in the proper golf swing. However, the device has the deficiencies noted above in that it is still possible for a golfer to swing improperly and not strike the upstanding pins.

BRIEF SUMMARY OF THE INVENTION

Briefly, the present invention provides a golf swing training device which provides the golfer holding a golf club with an immediate indication or feedback that the golfer has swung the club improperly in either a swing path which will result in a slice such as coming over the top, or in a swing path which will result in the ball being pulled. Further, the present invention provides the golfer a visible target to reinforce the desired inside-to-square swing plane.

The present invention includes a frame which may be portable or may be secured to a structure such as a wall. The frame supports a flexible panel which is approximately 4' wide and 7' tall and which may be divided into four sections each about 1' wide. A ball striking surface, such as a mat of artificial grass or carpet is positioned at the bottom of the panels and a tee location is positioned at a centered location spaced from the panels. A visible guide line extends through the tee parallel to the panel. Sensors are positioned on the guide line both forward and rearwardly of the tee a predetermined distance, as for example, about one foot. The sensors activate an alarm which provides an audible indication to the golfer that the club head has passed over the sensors.

In a preferred embodiment, the sensors include a reflector which reflects a beam of light energy emitted from light sources disposed at the upper part of the frame. The panels also carry indicia or markings forward of the tee which provide the golfer a target that the golfer will attempt to strike after passing the club through the tee area. This will reinforce the proper inside-to-square swing which is desired.

Positioned forward of the ball and to the golfer's side is a flexible member. The member is in the form of a post and may be fixed or may be detachably secured by removable fasteners such as loop and pile fasteners to the mat. Posts of varying height to be positioned in this location. When the golfer has taken the club back along the proper line during the back swing, the club head will cross the rear sensor and an audible signal will be provided. If the club has not been taken back properly, the sensor will not emit an audible signal. Similarly, if the golfer fails to properly pass the club over the sensor forward of the ball during the follow through, no signal will be provided by the forward sensor.

The panels serve as a wall or obstacle which trains the golfer in the proper swing as an improper golf swing will cause the golfer to strike the panels with the club stopping the swing. Because the panels extend upwardly corresponding to a location at least to a height corresponding to the shoulders of the golfer, the golfer cannot "beat" the device. The presence of the panel disposed opposite the golfer provides immediate feedback of an improper swing and because of the presence of the wall, the golfer will soon make the necessary corrections to avoid hitting the wall and therefore swing the club in a more proper alignment. The device can be used either with or without a golf ball with equal effectiveness. Further, the device is one that can be used with an instructor and which can also be used for practice without an instructor being present as the golfer will soon learn what corrections are necessary in order to cause the club to follow the proper swing path.

BRIEF DESCRIPTION OF THE DRAWINGS

The above and other objects and advantages of the present invention will become more readily apparent from the following description, claims and drawings in which:

DETAILED DESCRIPTION OF THE DRAWINGS

Figure 1:
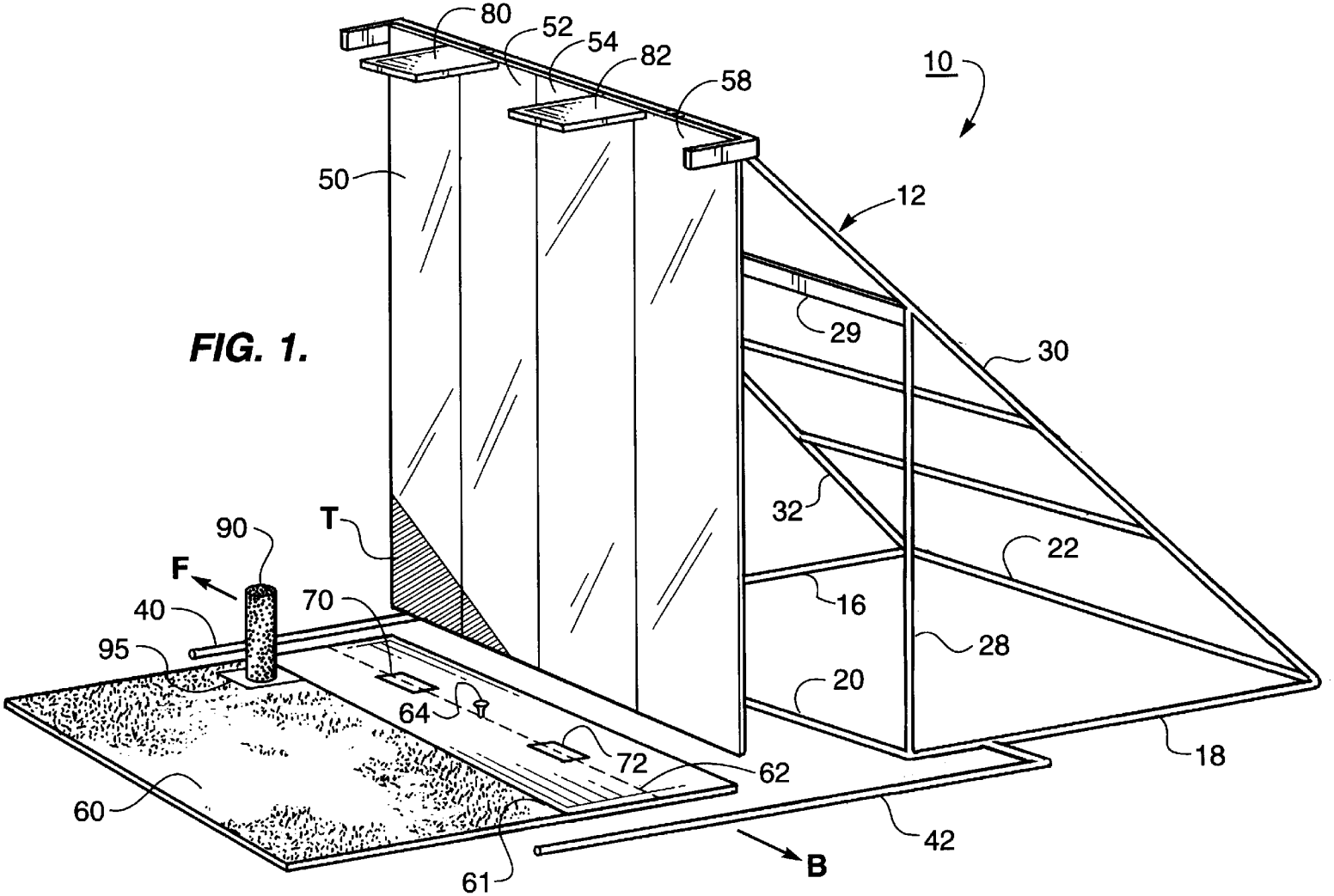
FIG. 1 is a perspective view of the golf swing training device of the present invention.

Referring to the accompanying drawings and particularly FIG. 1, the golf club swing training device of the present invention is generally designated by the numeral 10 and includes a frame 12 which includes a base having spaced-apart side member 16 and 18 joined by end members 20 and 22. A pair of uprights 28 extend vertically from the opposite ends of frame member 20 to an intermediate elevation where they are interconnected by a cross member 29. A pair of inclined supports 30 and 32 extend from the opposite ends of member 22 and are supported by uprights 28. The upper end of members 30 and 32 are interconnected by cross member 34. Although the overall height of the device may vary, the elevation of cross member 34 is preferably about 6' to 7' above the plane of members 16 and 18. Stabilizers 40, 42 extend forwardly of the frame and are attached to side rail members 16 and 18, respectively. The frame components may be constructed from any suitable material such as square or round tubing and secured by welding or conventional fastening techniques such as bolts or screws.

A panel 50 comprised of a plurality of flexible panels 52, 54, 56 and 58 are suspended in side-by-side arrangement from upper cross member 34. The panels 52, 54, 56 and 58 are preferably a durable transparent or translucent material such as a heavy gauge vinyl sheeting. The four sections form a panel or wall 50 which is approximately 4' in width and from about 6' to 7' in height positioned opposite the golfer so that the golfer in the normal position is facing the panels. It is important that the panel 50 extend to a height at least corresponding to the shoulder area of the golfer. Also, although four sections are shown, one or any convenient number of sections may be used to establish the panel.

The golfer stands on a surface shown as a mat 60 which may be carpeting and is preferably a surface simulating a natural golf course surface and may be synthetic turf or the like. The mat 60 may be of any convenient size but has a width dimension corresponding approximately to the width of the four panels and is approximately square. The mat is positioned so that the forward edge 62 approximately aligns with the bottom of the panel. A guide line 61 extends from the opposite edges of the mat parallel to edge 61 and parallel to the plane defined by the panel. At an intermediate location between the guide line 61 and the panel 50, a tee location is provided as indicated by the numeral 64. The tee location may include a small integrally formed resilient tee on which a ball may be placed.

Disposed on either side of the tee location 64 are sensors 70 and 72. Preferably sensors 70, 72 are reflectors which will reflect light impinging thereon to light sources 80, 82 projecting from cross member 34. When the beam of light from either of the sources 80 or 82 is broken or interrupted, an audible signal will be provided. Detection devices of this type are well known and various proximity photo-electric infra red, sonic devices or optical sensors which provide a signal when an object passes by or interrupts a beam may be used. Reference is made to U.S. Pat. No. 4,516,115 which shows a device of this general type.

It is to be noted that the description of this device is made with reference to use by right-handed golfers. It is to be appreciated that the mirror image of this device and its position would be suitable for use by left-handed golfers. Accordingly, in the drawings the arrow indicated by the letter "F" represents the path of forward or downswing motion and the arrow indicated by the letter "B" indicates the direction of the backswing when the device is used by a right-handed golfer.

Positioned forwardly of tee 64 adjacent the forward edge of the mat is an upright resilient member 90. Resilient member 90 may be a post or block of foam rubber or similar material either permanently secured to the mat or preferably secured at its bottom by hook and loop fastener material 95. By being detachably secured, post 90 can be replaced if it becomes damaged. Also, detachable securement permits posts 90 of varying height to be used depending upon the physical characteristics of the golfer using the device.

To further increase the effectiveness of the device, a target area "T" is provided on the lower corner of panel 50. This target area will assist in giving the golfer a visual target to assist the golfer in maintaining the proper inside-to-square swing.

In use, the device of FIG. 1 is a freestanding device and may be located at any convenient location, outdoors on a golf course or indoors in a garage or basement area. The device serves to provide the golfer holding a golf club immediate feedback of an incorrect swing. An improper golf swing will cause the golf club to hit the wall which will stop or impede the swing. The presence of the wall is intimidating so that the golfer will quickly learn to bring the club back and through the ball on a proper line 62 to avoid hitting the wall and to activate both of the sensors 70, 72. Note the device can be used as a practice device with the golf ball in place on tee 64 or may be used by taking practice swings without a ball in position. The golfer will position himself or herself on the mat 60 addressing the ball or tee 64. In this position, the golfer is facing the curtains which are suspended opposite the golfer and spaced a distance from the intended path indicated by the line 61.

Figure 3:
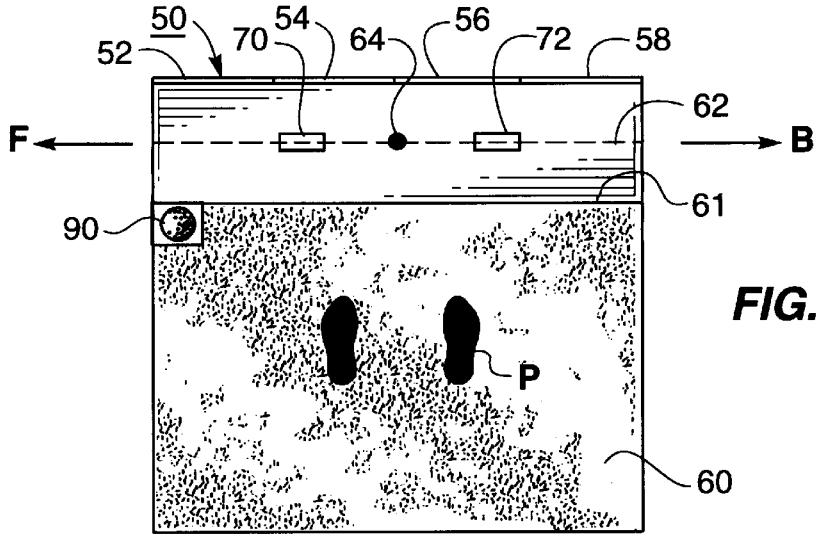
FIG. 3 is a top view of the device with the frame omitted.

Referring to FIG. 3, the golfer in this position takes the club rearwardly along the correct swing plane indicated by the line 62, the rearward or back swing motion of the golf club will interrupt the rear light beam reflected from sensor 72 providing an audible sound to the golfer indicating the proper take-away. The golfer's feet are represented by the pair of foot prints. If the swing plane is correct on the downswing and follow-through, the golf club will tend to approximate line 62 and will again pass through both sensors 70 and 72 interrupting both of the light beams and also providing audible indications of a correct swing plane.

Figure 4:
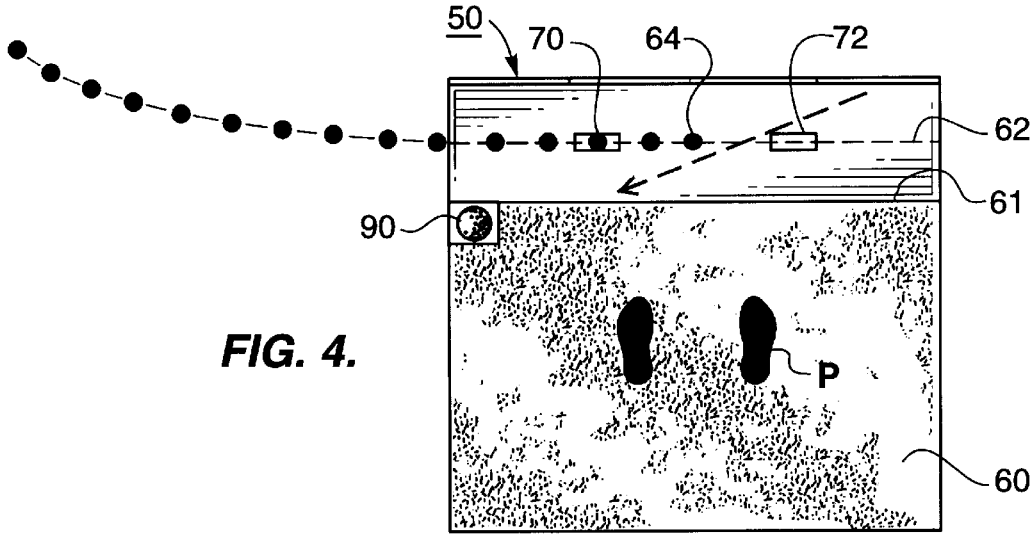
FIG. 4 is a top view of the device showing an over-the-top or golf club path which will result in a slice.
Figure 6:
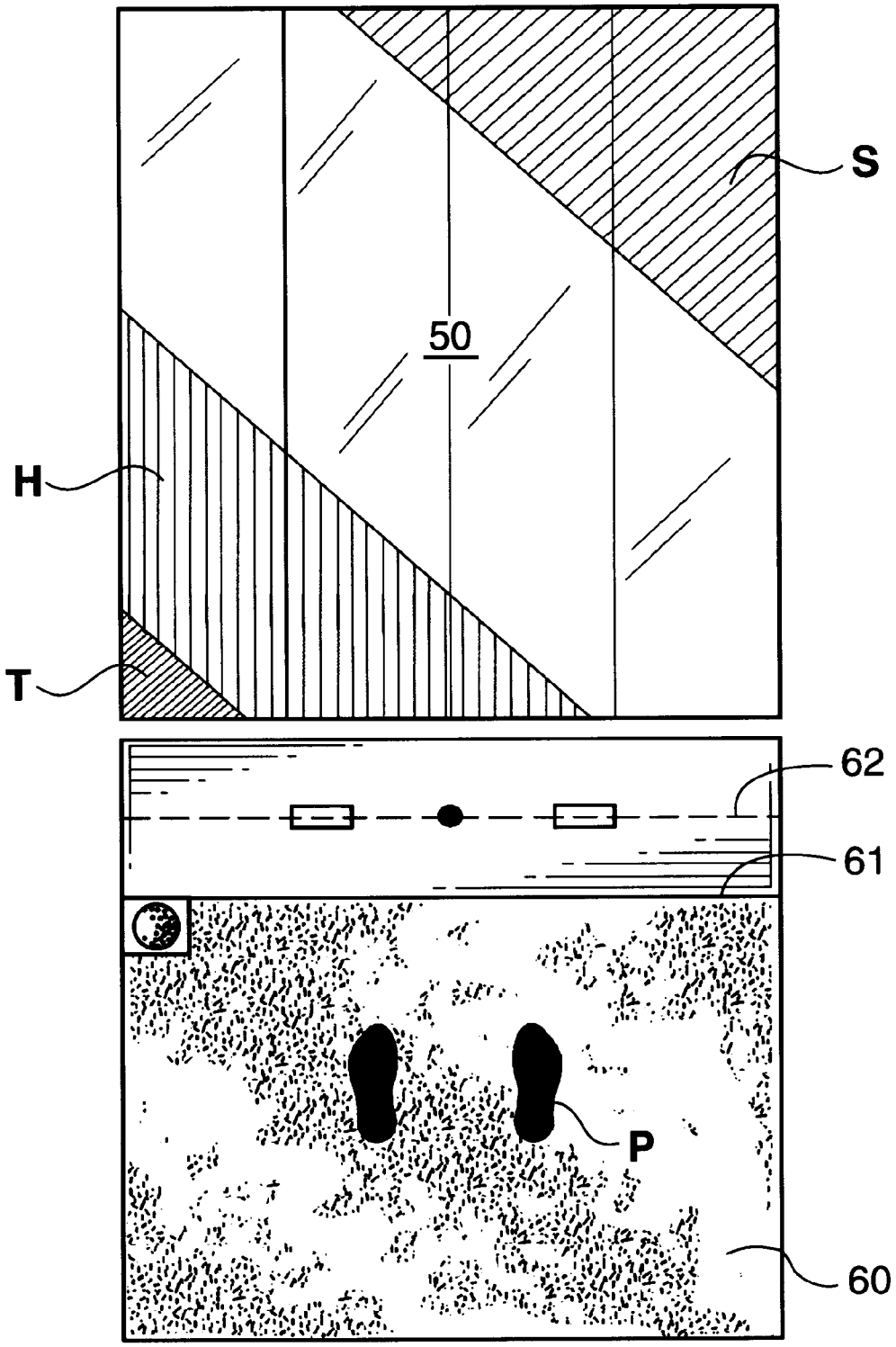
FIG. 6 is a perspective view of the training device of the present invention with the frame omitted showing the areas in which a slice or hook swing will impact the panels.

Referring to FIG. 4, the proper swing is indicated by the dotted line 61. The golfer's position is indicated by the outline of the golfer's feet "P". When the golf club is brought back on the proper line, it will interrupt the first sensor 72 which, in turn, emits an audible signal. If the club is not brought back correctly, an audible signal will not be given indicating that the backswing is improper. On the downswing and follow-through, the proper swing path will activate the forward alarm passing across sensor 70. If the follow-through is incorrect, no signal will be emitted. The presence of the panel 50 forces the golfer to swing properly which means swinging the club down the target line 62. Most golfers tend to slice, which in the case of a right-handed golfer causes a club to follow a path as indicated in FIG. 4. The slice is generally the result of "hitting from the top" which is the result of a forward motion of the upper half of the golfer's body. If a golfer swings in this manner, the club will impact the panel in the slice area "S" indicated in FIG. 6. If the golfer swings correctly, the club will not strike the wall and will travel down the guide line 62. The golfer having an improper or over-the-top or slicing swing will quickly learn to correctly swing down the target line in a short while due to the deterrent training effect of striking the panel.

Figure 5:
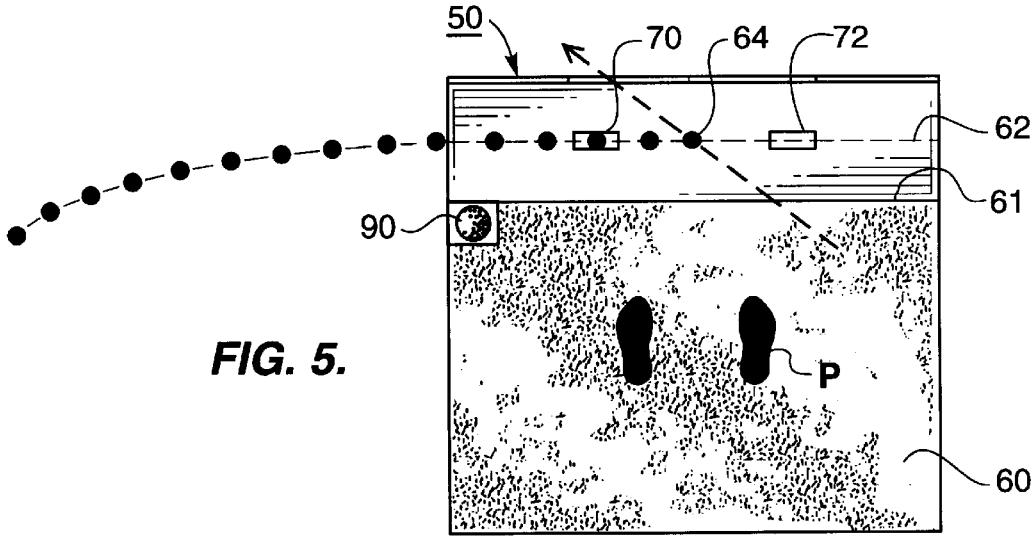
FIG. 5 is a top view of the device of the present invention with the frame omitted showing a swing path which will cause a hook.

The present invention will also assist in preventing the hook swing. The hook swing is shown in FIG. 5 in which the club line is shown as an exaggerated in-to-out path. The hook swing will impart spin to the ball causing the ball to start in a straight direction and then curve to the left. The more pronounced the hook, the more pronounced the leftward movement of the ball. If the golfer swings in a hook path, the club will hit the wall in the area indicated in FIG. 6 and indicated by hook.

To further assist the golfer, the lower left hand corner of panel 50 carries indicia which the golfer attempts to hit with the club. The natural turning motion of the body will generally not allow the club to hit the area "T" but will help to teach the golfer not to come over the top and to swing the club in a slight inside-to-square path which is desired in many shots as it imposes top spin on the ball providing greater distance.

To further teach proper swing path, the post 90 provides an additional barrier which will be struck if the club is properly taken back and swung along the guide line 62 missing the panels that the golfer's finish is not proper. For example, if the golfer spins his or her body, the club after passing by the sensor 70 will move in an arc to the left. Desirably the golfer should finish in a straight line with the golfer's hands high. If the golfer does not do this, the club head will strike the post 90 providing an immediate tactile indication of the improper path on the follow through.

Figure 2:
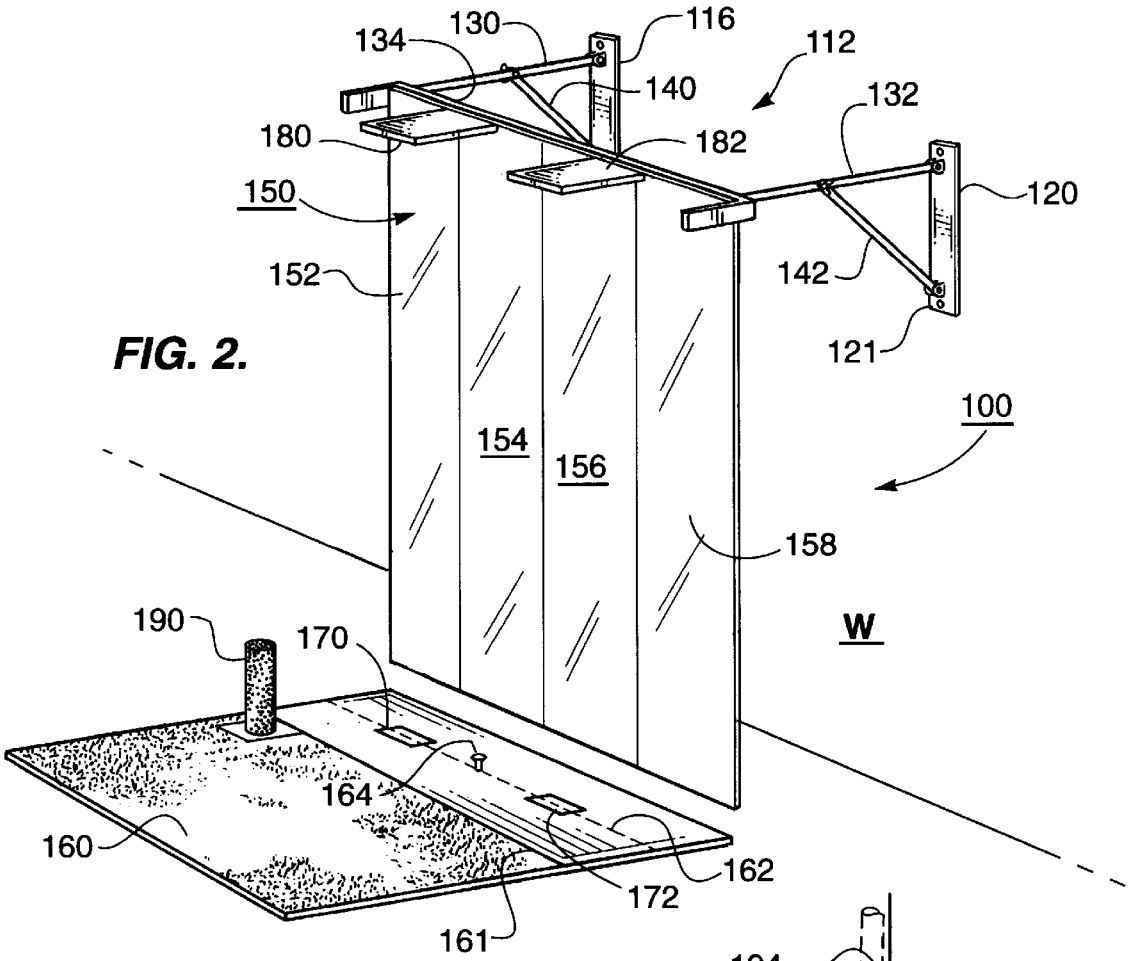
FIG. 2 is a perspective view of another embodiment of the golf swing training device of the present invention which embodiment is designed to be attached to a wall or other upstanding structure.
Figure 2A:
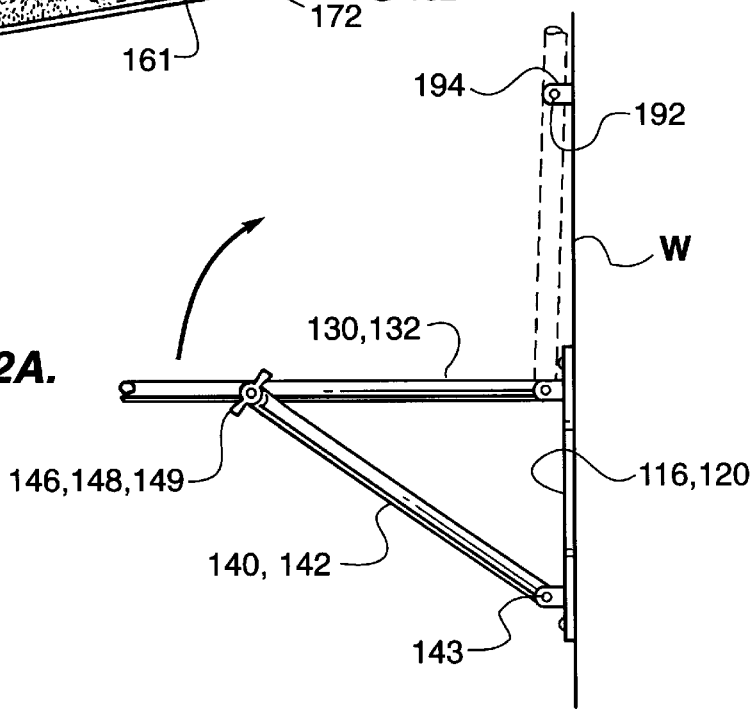
FIG. 2A is a detail view of a portion of the frame of the device of FIG. 2.

The device as described with reference to FIG. 1 is a freestanding device which, as indicated, can be set up at any location. It may be desirable and preferred by some users to establish a permanently mounted version which can be secured to the wall of a garage, side of a building or other structure. Referring to FIGS. 2 and 2A, an alternate embodiment of the training device of the invention is shown generally designated by the numeral 100. In this version, a frame 112 is provided which has a pair of spaced-apart brackets 116, 120 which are bolted or otherwise secured to vertical wall "W" by suitable fasteners 121. A pair of arms 130, 132 are pivotally connected at their inner ends to the brackets 116, 120 respectively. In the use-position, arms 130, 132 are maintained in a generally horizontal position by braces 140 and 142. Brackets 140, 142 are also pivotally connected to brackets 116, 120 at their inner ends 143 and detachably secured to arms 130, 132 by fasteners 146 which register in holes 148 provided at intermediate location of arms 130, 132. The fasteners are secured by wing nuts 149.

A cross member 134 extends between the outer ends of arms 130, 132. A panel 150 comprised of a plurality of panel sections 152, 154, 156 and 158 are suspended from cross member 134 as has been described above. Similarly, a mat 160 may be positioned at a location adjacent the lower end of the panels. The mat is provided with upstanding flexible post 190 and carries a tee area 164 and a transversely extending guide lines 161 and 162 extending parallel to the lower end of the panel 150. Sensors 170 and 172 are provided in the surface of the mat and will serve to re-direct light energy emitted from sources 180, 182. As has been described, if the beam of light is broken by the club head, an audible or visual signal will be provided to the golfer.

In other respects, the embodiment shown in FIGS. 2 and 2A is similar to that as has been described in FIG. 1 and is used in the same manner as has been described with reference to FIGS. 3 through 6. The advantage of the embodiment of FIGS. 2 and 2A is that it may be installed in a fixed location and may be easily folded to an out-of-the-way position simply removing pins 146 at the upper end of braces 140, 142. The arms 130, 132 may then be pivoted upwardly so that the panels 150 to 156 assume a position adjacent wall "W". The arms can be maintained in this position by inserting pins 146 into holes 192 in retainers 194 which will register with the holes in arms 130, 132 in the folded position. The mat 160 can be also removed and conveniently stored.

From the foregoing, it will be seen the present invention provides a golf swing trainer which is simple, versatile, and which will quickly alert the user when the golf swing is improper. The device will assist in curing the common slice as well as the hook. If the golfer's swing is incorrect, the golfer will either hit the flexible panels with the club or will strike the foam block forward of the golfer. The incorrect take-away and follow-throughs will be further indicated by the absence of the audible signals which are activated if the club is swing properly. The device may be used with an instructor or may be used for practicing in the absence of an instructor either with or without a golf ball.

It will be obvious to those skilled in the art to make various changes and modifications to the invention described herein. To the extent these various changes and modifications do not depart from the spirit and scope of the invention, they are intended to be encompassed therein.

I claim:

1. A golf swing training device for training a golfer in swinging a golf club along a proper swing path on a practice surface, said training device comprising:

(a) a support;

(b) a flexible panel having a top, bottom and side edge and suspended from said support in a generally freely hanging vertical position in which the panel extends from an elevational at least above the shoulder height of a golfer and in width to at least the width of a golfer's stance;

(c) a tee area for placement of a golf ball positioned from said panel so a golfer may assume an address position facing the ball and panel; and (d) a resilient member positioned on the surface spaced from said panel and located in the area of a golfer's forward swing whereby an incorrect golf swing path with a golfer holding a club will cause a club to impact either the panel or the resilient member.

2. The golf swing training device of claim 1 wherein said panel is transparent and is comprised of multiple sections.

3. The golf swing training device of claim 1 wherein said practice surface defines a swing path line generally parallel to the plane of said panel and extending through said tee area in a direction of intended ball flight.

4. The golf swing training device of claim 1 wherein said panel is provided with target indicia adjacent the lower edge thereof in a direction forward of a golfer.

5. The golf swing training device of claim 1 wherein said support is tubular frame construction having a base, uprights and a cross member.

6. The golf swing training device of claim 1 wherein said support has brackets securable to a vertical structure and arms supporting a cross member, said arms being foldable between a use position extending from said structure to a stored position substantially adjacent said structure.

7. The golf swing training device of claim 1 further including sensor means disposed on opposite sides of said tee area which will emit an audible signal when a golf club is moved in close proximity thereto.

8. The golf swing training device of claim 7 wherein said sensor means each comprise a transmitter which generates a beam of energy and a receiver and which beam if interrupted emits a signal, one of said transmitters and receiver being located on said practice surface adjacent said tee area.

9. The golf swing training device of claim 1 wherein said panel is generally rectangular and is at least approximately 4' in horizontal width and 7' in height.

10. A method of golf instruction for training a golfer to swing a golf club along a desired swing path on a practice surface, said training device comprising:

(a) providing a tee area on the practice surface;

(b) suspending a flexible panel having a top, bottom and side edges in a generally freely hanging vertical position in which the panel extends from the practice surface to an elevation at least the shoulder height of a golfer and at least the width of a golfer's normal foot stance;

(c) positioning a golfer in an address position facing the panel and ready to swing the golf club through the tee area, with the tee area being spaced from the panel a distance less than the length of a golf club; and (d) positioning a resilient member spaced from said panel and located in the area of a golfer's forward swing whereby an incorrect swing path with a golfer holding a club will cause a club to impact either the panel or the resilient member providing instant feed back to a golfer.

11. The method of claim 10 wherein said providing a tee area further includes positioning sensors in the tee area generally along a proper swing path, said sensors emitting a signal if a club is passed in close proximity thereof.

* * * * *